US005269518A

United States Patent [19]

Kobayashi et al.

[11] Patent Number: 5,269,518

[45] Date of Patent: Dec. 14, 1993

[54] GRIP-WEIGHTED PUTTER

[75] Inventors: Masashi Kobayashi; Masanobu Minami; Yoshio Tanabe; Yuuzi Mori, all of Matsudo, Japan

[73] Assignee: Maruman Golf Kabushiki Kaisha, Tokyo, Japan

[21] Appl. No.: 813,277

[22] Filed: Dec. 26, 1991

[30] Foreign Application Priority Data

Dec. 28, 1990 [JP] Japan ..... 2-409034

[51] Int. Cl.[5] ..... A63B 53/00; A63B 53/14

[52] U.S. Cl. ..... 273/81 A; 273/167 F; 273/169; 273/80 A

[58] Field of Search ..... 273/81 A, 167-175, 273/193 B, 77 R, 77 A, 80 R-80 D

[56] References Cited

U.S. PATENT DOCUMENTS

| | | | |
|---|---|---|---|
| 1,696,462 | 12/1928 | Victor | 273/81 A |
| 3,606,327 | 9/1971 | Gorman | 273/81 A |
| 3,679,207 | 7/1972 | Florian | 273/80 A |
| 4,058,312 | 11/1977 | Stuff et al. | 273/77 A |
| 4,280,700 | 7/1981 | Plagenhoef | 273/81 A X |
| 4,415,156 | 11/1983 | Jorgensen | 273/77 A |
| 4,674,746 | 6/1987 | Benoit | 273/81 A |
| 4,690,407 | 9/1987 | Reisner | 273/81 A |
| 4,869,507 | 9/1989 | Sahm | 273/167 H X |
| 4,872,683 | 10/1989 | Doran et al. | 273/167 H X |
| 4,887,815 | 12/1989 | Hughes et al. | 273/77 A |
| 4,971,321 | 11/1990 | Davis | 273/81 A X |

*Primary Examiner*—V. Millin
*Assistant Examiner*—Sebastiano Passaniti
*Attorney, Agent, or Firm*—Armstrong, Westerman, Hattori, McLeland & Naughton

[57] ABSTRACT

Disclosed is an improved putter whose head and grip weighs 320 to 360 grams and 100 to 260 grams, respectively. The total weight of the head and grip ranges from 445 to 585 grams. The grip-and-head weighting according to the present invention has the effect of improving the rolling of the ball to extend the rolling-and-running distance of the ball; and improving the stableness and directionality of the swing.

1 Claim, 8 Drawing Sheets

1 ···· Grip
2 ···· Head
3 ···· Shaft
5 ···· Putter club

O ···· Center point of swing
C ···· Grip end
G ···· Center of gravity of club
H ···· Center of gravity of head (a) Shoulder type (b) Arm type (c) Tap type (a) Which putter is easiest and which is least easy to swing ?

(b) Evaluation content

GRIP-WEIGHTED PUTTER

BACKGROUND OF THE INVENTION

1. Field of the Invention

The present invention relates to a golf club, particularly a putter whose grip is so weighted that the most effective stroke may be assured.

2. Description of Related Art

A putter comprises a shaft having a head and a grip fixed to its opposite ends. The weights of these components of a standard putter using a steel shaft are as for instance, follows:

| | |
|---|---|
| head weight | $W_H = 320$ g |
| grip weight | $W_G = 65$ g |
| shaft weight | $W_S = 115$ g |
| total weight | $W_T = 500$ g |

If use is made of a carbon shaft, FRP shaft or any other light-weight shaft weighing 30 to 80 grams, the total weight $W_T$ ranges from 415 to 465 grams.

As is well known, it is important in putting that a golf ball can be controlled to rotate and run accurately in the distance and the direction. To increase the rotating-and-running distance it is necessary to give an increased amount of kinetic energy to the ball at the time of hitting whereas to control the rotating-and-running direction with accuracy it is necessary to give a stable swing to the putter club with the front part or face of the head facing perpendicular to the rotating-and-running direction. In respect of this the club should be designed so as to permit players to swing it with ease.

In an attempt to improve the rolling of balls, the head of a putter is designed so as to be heavier than the above standard head weight $W_H$. A somewhat heavier head is used initially, or an adjustment is done by attaching a lead weight to the head of a putter later. The kinetic energy which is given to a golf ball at the time of hitting is given by the following equation:

$$E=\tfrac{1}{2}MV^2=\tfrac{1}{2}W_H/g\ V^2 \qquad (1)$$

wherein

M: mass of the head of a putter;

V: velocity of the head; and $W_H$: weight of the head.

As is apparent from the equation, the kinetic energy increases with the weight of the head $W_H$, and the increase of the kinetic energy will improve the rolling of balls. On the other hand the club cannot be swung with ease, and therefore, the stable stroke and the correct directionality are hardly attainable.

SUMMARY OF THE INVENTION

In view of the above one object of the present invention is to provide a putter which improves the rolling-and-running of balls and at the same time, the stableness and directionality of the stroke.

To attain this object according to the present invention, a putter golf club comprising a shaft having a head and a grip fixed at its opposite ends is characterized in that: said head weighs 320 to 360 grams; said grip weighs 100 to 260 grams; and the total weight of said head and grip ranges from 445 to 585 grams.

The center of gravity of said grip may be located 100 to 150 millimeters apart from the end of said grip.

The grip weighing 100 to 260 grams, is heavier than the grip of a conventional club, which grip weighs 65 grams. Accordingly the center of gravity of the club gets closer to the end of the grip with the result that the club can be swung more easily than the conventional club, increasing the speed of the head in swinging and accordingly increasing the kinetic energy of the golf ball to improve the rolling of the ball. The increased easiness with which the club can be swung has the effect of improving the stableness and directionality of the stroke.

If the center of gravity of the grip is 100 to 150 millimeters apart from the end of the grip, the center of gravity of the grip is positioned at the middle of the grip, thus putting the center of gravity of the grip in both hands when the grip is held in hands. This permits the grip and hands to combine together so as to form a whole, thus facilitating the swinging of the club.

Other objects and advantages of the present invention will be understood from the following description of grip-weighted putters according to preferred embodiments of the present invention referring accompanied drawings.

DESCRIPTION OF THE PREFERRED EMBODIMENTS

Figure 1:
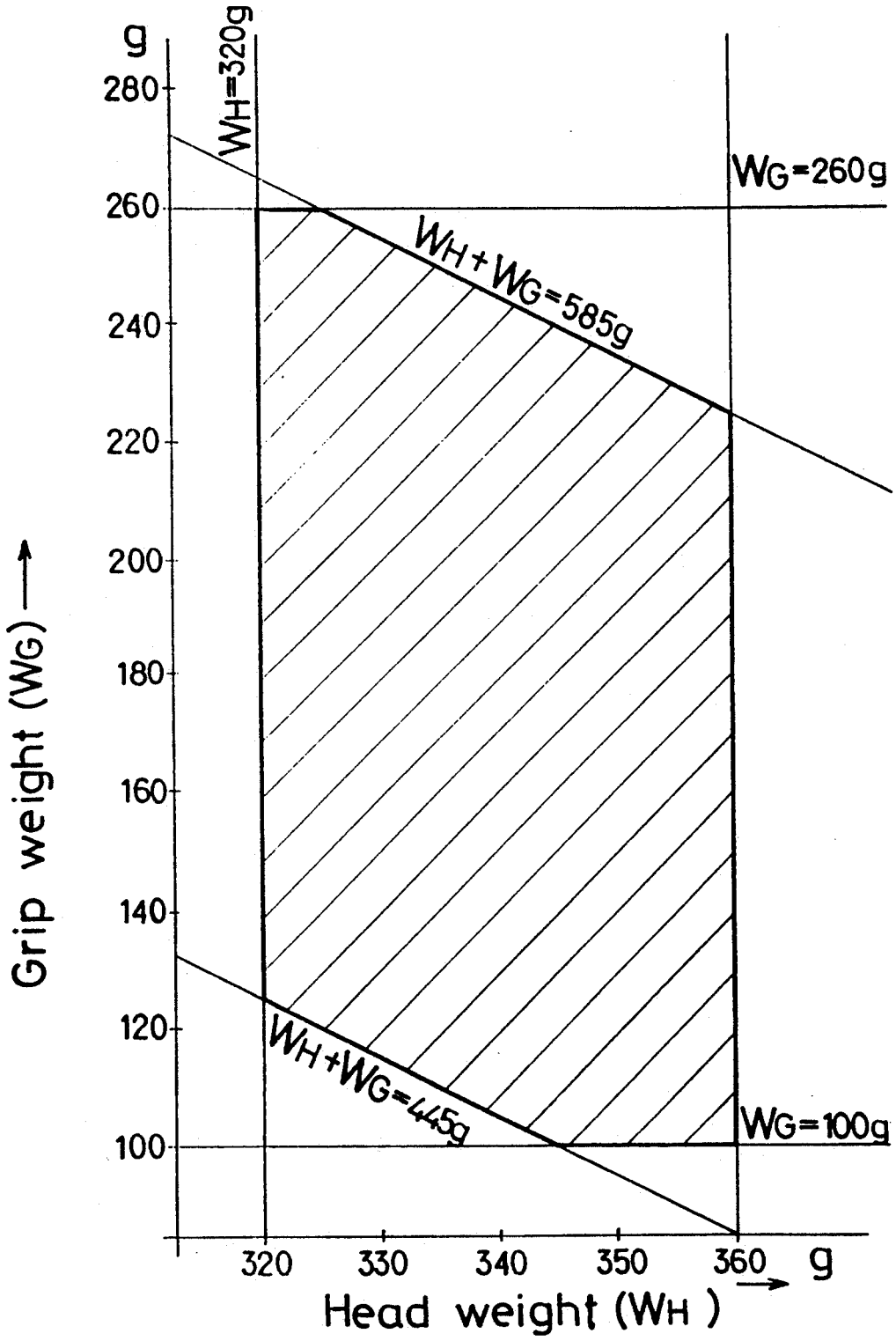
FIG. 1 is a weight-distribution diagram showing the domain of possible combinations of head and grip weights.

FIG. 1 is a weight-distribution diagram which shows the domain (hatched area) of possible combinations ($W_H+W_G$) of head weight $W_H$ and grip weight $W_G$ in designing putters according to the present invention. Any putters whose head-and-grip weights fall within the hatched area are found to have the effect of improving the rolling of golf balls and of increasing the stableness of the stroke and improving the directionality of the stroke. This finding is based on the following theoretical analysis and experimental data.

The following physical quantities are selected for determining conditions in which strokes are given to putters.

(1) The amount of energy E to be given to a golf ball:

$$E=\tfrac{1}{2}M_HV_H^2=\tfrac{1}{2}W_H/g\cdot V_H^2 \qquad (1)$$

where $M_H$: mass of the head of a putter;

$V_H$: velocity of the head;

$W_H$: weight of the head; and g: acceleration of gravity.

Figure 2:
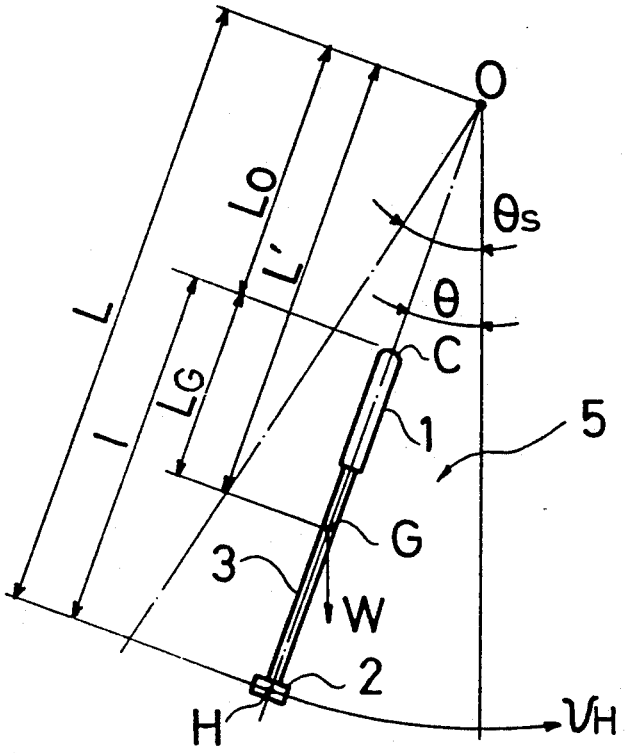
FIG. 2 schematically shows a club swinging apparatus for measuring the speed of the head.

(2) The speed of the head:

As seen from FIG. 2, a putter club 5 comprises a shaft 3 having a head 2 and a grip 1 fixed to its opposite ends. The center point of swing O is located on the line extending upwards from the end C of the grip 1; the center of gravity of the putter club 5 is indicated at G; and the center of gravity of the head 2 is indicated at H. The end C of the grip 1 is connected to the center point of swing O to form a pendulum. When the club is swung about its center point O, the speed $V_H$ of the head 2 is given by the following equation:

$$I_O\theta = -L' \cdot W_T \sin\theta \quad (1)$$

where $I_O$: inertia moment of the club 5 about the center point of swing O;

L': distance from O to G;

$W_T$: total weight of the club;

$\theta$: swing angle of the pendulum; and $\theta$: angular acceleration of pendulum swing.

The general solution of Equation (2) is given by:

$$\omega = \theta = \sqrt{2W_T L'/Io\,(\cos\theta - \cos\theta\, s)} \quad (3)$$

where $\omega = \theta$: angular acceleration of pendulum swing; and $\theta_S$: initial angle formed between the vertical line and the starting line of the pendulum.

The head speed $V_H$ is given by:

$$V_H = L\omega = L\sqrt{2W_T L'/Io\,(\cos\theta - \cos\theta\, s)} \quad (4)$$

where

L: distance from O to H; and $L' = OG = OC + CG = L_O + L_G$

The following values which are presumably actual values for an ordinary putting, are added to Equation (4) as substitutes for the corresponding variables.

$L_O = 20$ cm $\theta = 0°$ $\theta_S = 40°$ $L' = L_O + L_G = 20\text{ cm} + L_G$ $L = l$ (C to H length) $+ L_O = 34$ inch $+ 20$ cm $= 106.36$ cm $$V_H = 2277 \times \sqrt{(20 + L_G)\, W_T/Io} \quad \text{(cm/s)} \quad (5)$$

The units of these variables are:

$W_T$: (kg·f)

$L_G$: (cm)

$I_O$: (kg·cm$^2$)

Given values of these variables are added to substitute for corresponding variables in Equation (5) to determine head speeds $V_H$. $I_O$ is determined by:

$$\begin{aligned} Io &= I_G + M_T(L')^2 \\ &= I_G + W_T/g(L')^2 \end{aligned} \quad (6)$$

where $I_G$: inertia moment about the center of gravity of the putter; and $M_T$: total mass of the putter.

The inertia moment $I_C$ about the grip end C is given by:

$$I_C = I_G + W_T/g\, L_G^2 \quad (7)$$

The easiness for a player to swing a putter, i.e. the feeling of swinging will be greatly influenced by this inertia moment $I_C$.

A conventional putter (referred to as "MODEL A") and putters whose heads and grips are weighted according to the present invention (referred to as models "B", "C", "D" and "E") were prepared, and the head speeds $V_H$, kinetic energies and inertia moments $I_C$ of these putter models were determined according to the above equations. The results are given in the following Tables 1 and 2.

TABLE 1

| Model No. | $W_H$ (g) | $W_G$ (g) | $W_S$ (g) | $W_T$ (g) | $I_G$ (kg · cm$^2$) | $L_G$ (mm) | $I_C$ kg · cm$^2$ |
|---|---|---|---|---|---|---|---|
| A | 320 | 65 | 115 | 500 | 478.7 | 649.9 | 2590.6 |
| B | 320 | 125 | 115 | 560 | 601.1 | 605.9 | 2656.9 |
| | | (A + 60) | | (A + 60) | | | |
| C | 320 | 265 | 115 | 700 | 886.9 | 503.2 | 2659.4 |
| | | (A + 200 | | (A + 200 | | | |
| D | 360 | 100 | 115 | 575 | 569.5 | 639.3 | 2919.6 |
| | (A + 40) | (A + 35) | | (A + 75) | | | |
| E | 360 | 225 | 115 | 700 | 843.8 | 550.9 | 2968.2 |
| | (A + 40) | (A + 160 | | (A + 200 | | | |

A: conventional standard putter club

B~E: A + a (weight added)

$W_H$: head weight $W_G$: grip weight $W_T$: total weight of putter club $I_G$: inertia moment about the center of gravity of the club $L_G$: distance from grip end to center of gravity of the club $I_C$: inertia moment about the grip end $W_S$: shaft weight

TABLE 2

| Model No. | $V_H$ (cm/S) | $V_H$ ratio to A | E (kg · cm$^2$/S$^2$) | E ratio to A |
|---|---|---|---|---|
| A | 232 | 100% | 8612 | 100% |
| B | 235 | 101.3 | 8836 | 102.6 |
| C | 242 | 104.3 | 9370 | 108.8 |
| D | 233 | 100.4 | 9772 | 113.5 |

TABLE 2-continued

| Model No. | $V_H$ (cm/S) | $V_H$ ratio to A | E ($kg \cdot cm^2/S^2$) | E ratio to A |
|---|---|---|---|---|
| E | 239 | 103.0 | 10280 | 119.4 |

$V_H$: head speed
E: kinetic energy

Figure 3:
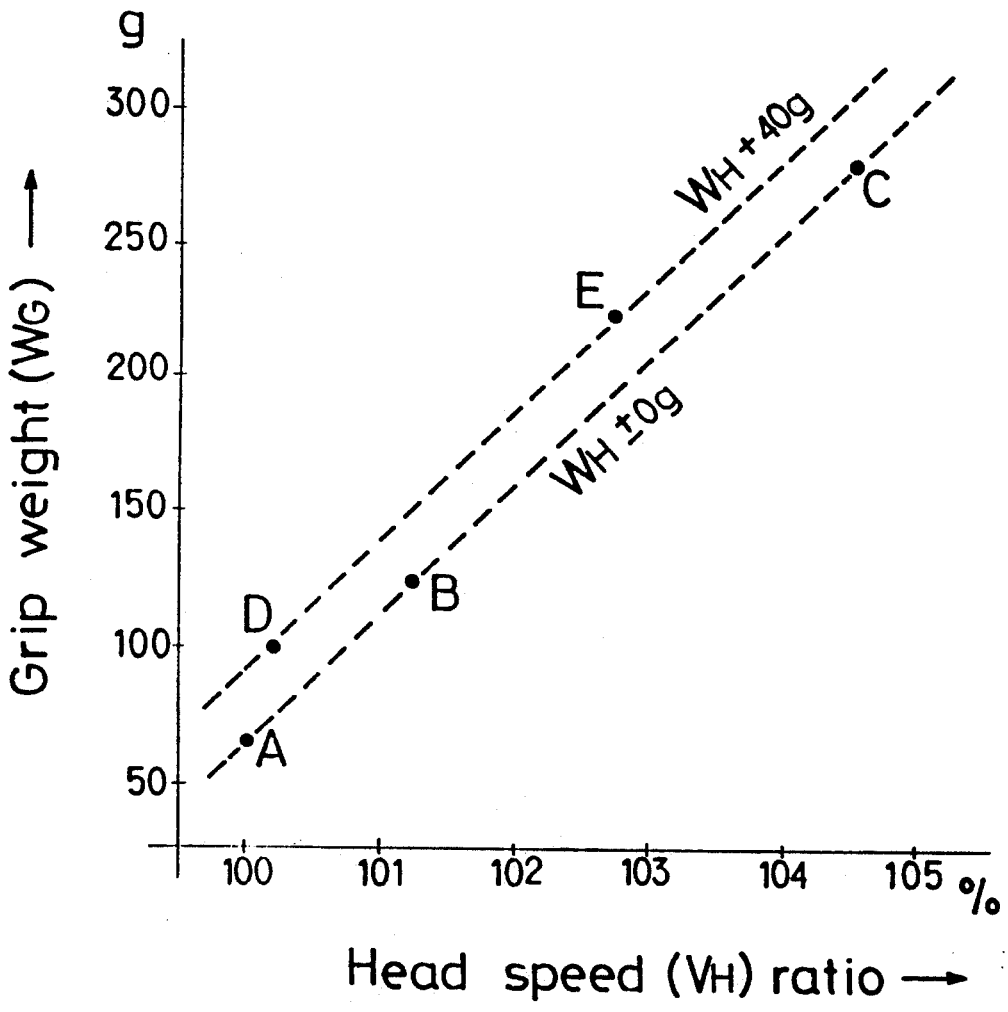
FIG. 3 is a graph representing the relationship between grip weight and head speed ratio.
Figure 4:
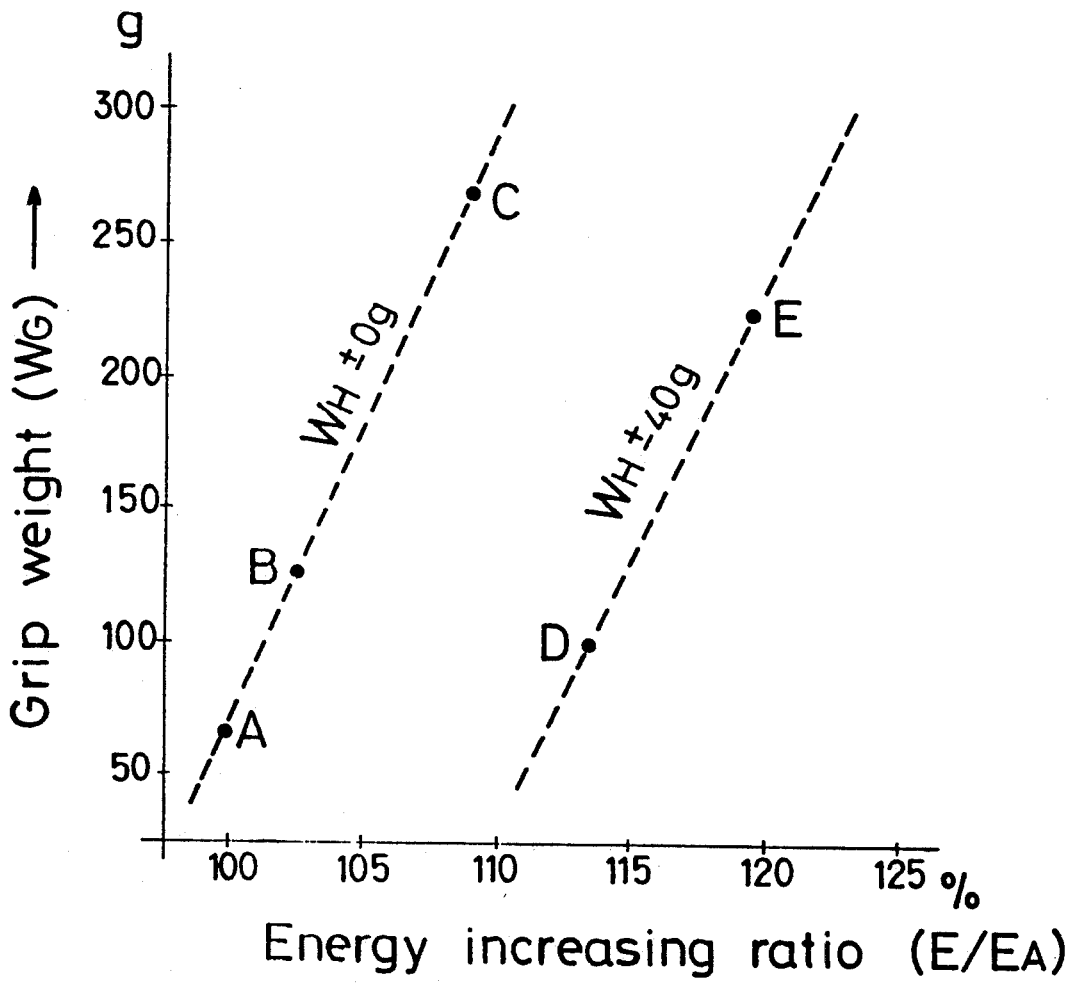
FIG. 4 is a graph representing the relationship between grip weight and head's kinetic energy.
Figure 5:
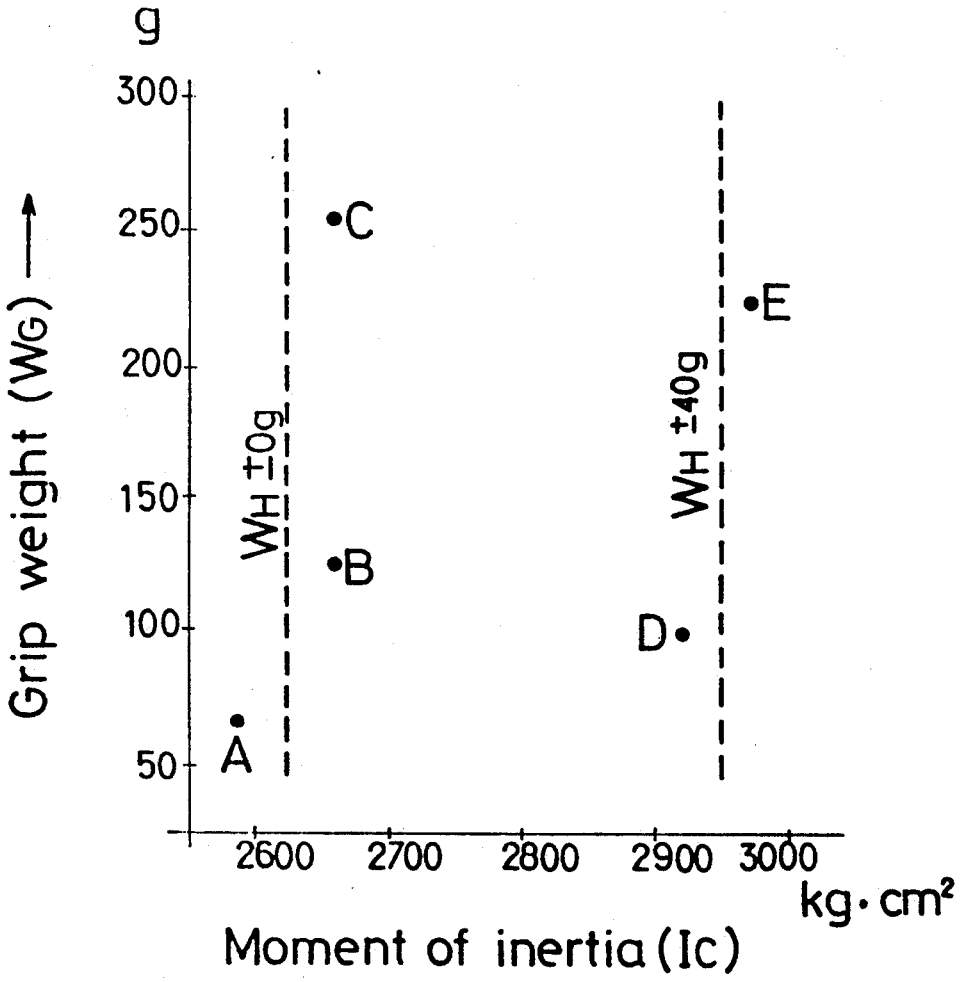
FIG. 5 is a graph representing the relationship between grip weight and the inertia moment of the club about its grip end.

As regards models A to E, the graphs of FIGS. 3, 4 and 5 show how the head speed ratio ($V_H$ of each of models B to E/$V_H$ of model A) varies with grip weight; how the energy increasing ratio (energy E each of models B to E/energy E of model A) varies with grip weight; and how the inertia moment $I_C$ varies with grip weight. As seen from FIG. 4, the energy E increases with the increase of the grip weight $W_G$, and the energy E increases greatly when extra weight is added to the head. Also, as seen from FIG. 5, the inertia moment $I_C$ is independent from the increase or decrease of the grip weight $W_G$, but the inertia moment is greatly influenced by increasing or decreasing the head weight $W_H$.

Figure 6:
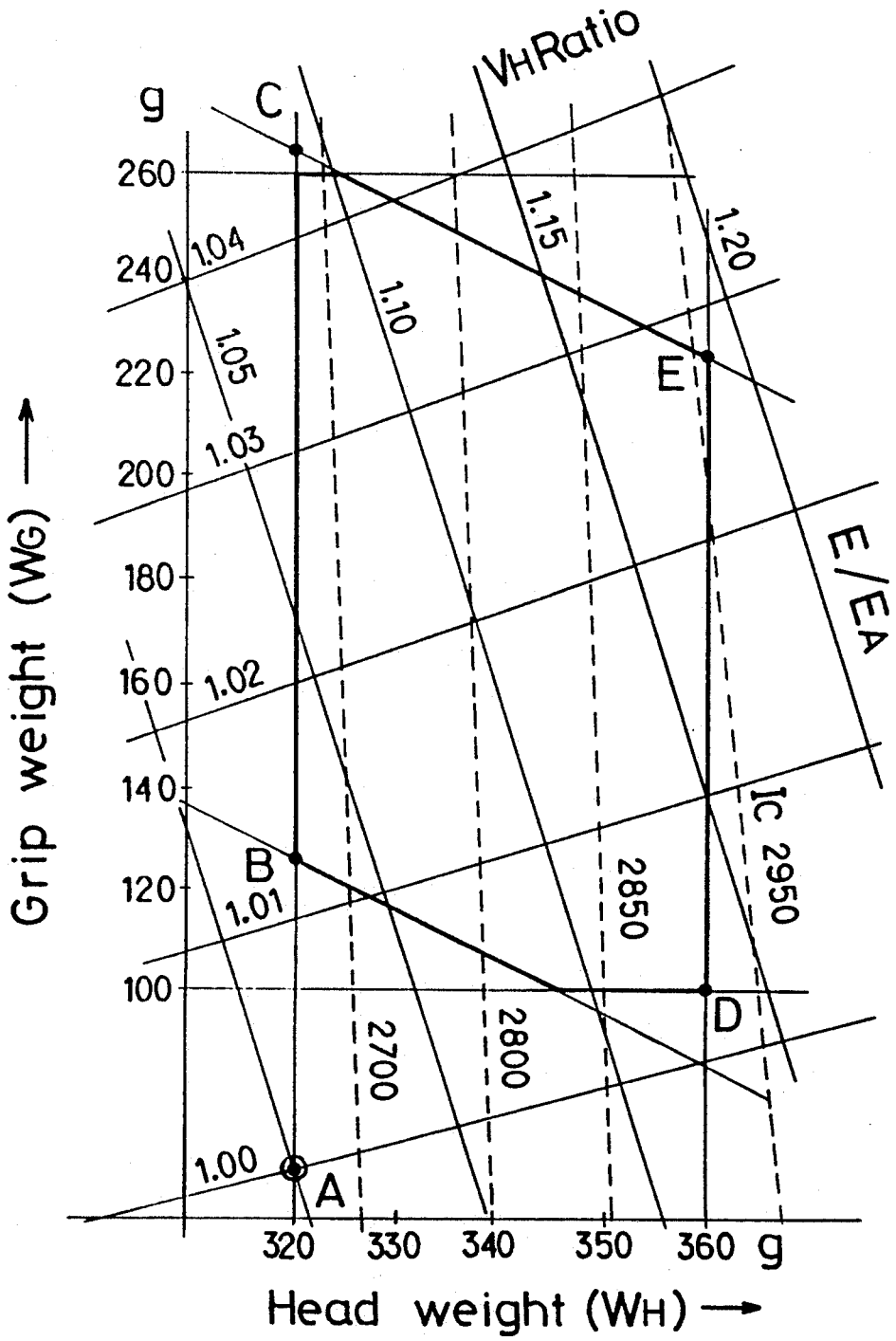
FIG. 6 is a diagram showing how the head speed ratio, the kinetic energy incremental ratio of the head and the inertia moment of the club about its grip end vary with grip weight and head weight.

FIG. 6 shows data pertaining to numerous combinations of different grip weights and head weights, which are provided by adding extra weights of 50 g, 62.5 g, 75 g, 87.5 g, 100 g, 150 g and 200 g to the grip weight of model A and by adding extra weights of 12.5 g, 25 g, 37.5 g and so forth to the head weight of model A. The shaft of model A was made of steel, and it weighed 115 g. In FIG. 6 points A, B, C, D and E indicate the head weights $W_H$ and grip weights $W_G$ of model A to E given in Table 1. Putters according to the present invention fall within the domain defined by thick line connecting points B, D, E and C. Point A remains out of the specific domain, clearly indicating in the diagram, the difference between the conventional putter A and putters according to the present invention.

The graph of the $V_H$ ratio in FIG. 6 shows that the increase of the grip weight $W_G$ is more effective to increase the head speed $V_H$ than the increase of the head weight $W_H$. Also, it shows that the increase of the head weight $W_H$ is more effective to increase the energy E than the increase of the grip weight $W_G$. The increase of the head weight $W_H$, however, will permit a great increase of inertia moment $I_C$ with the result that the stableness and directionality of swinging is lowered. A compromise between the grip weight and the head weight of a putter according to the present invention was made in consideration of these factors, and most appropriate shares between the grip weight $W_G$ and the head weight $W_H$ are found in the domains defined by thick lines in FIGS. 1 and 6.

In determining such domains of most appropriate grip-and-head weight shares tens of golf players including professional players tried a variety of grip-weighted putters according to the present invention, and their evaluations of these grip-weighted putters were collected.

Specifically four grip-weighted putters were tested, and their grips weighed 115 g, 165 g, 215 g and 265 g. These are heavier than the grip of the conventional standard putter model A (65 g) by extra weight of 50 g, 100 g, 150 g and 200 g respectively. The weighting distribution along the grip length was so determined that the center of gravity of each grip was 100 to 150 millimeters apart from the grip end C, that is, around the midpoint of the grip length.

Almost all golf players (94%) said that the grip-weighted putters were easy to swing. One half or more of the golf players made a favorable comment on the putters whose grips had extra weight of 100 g and 150 g. They said that the putters whose grips had extra weights of 50 g were hardly distinguishable from the conventional standard putter, and that the putters whose grips had extra weight of 200 g were too heavy, and they are anxious about a long- distance putting.

Figure 7:
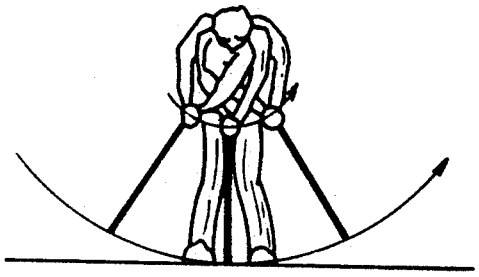
FIG. 7 show different putting postures.
Figure 7:
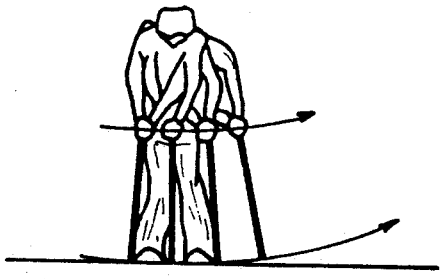
Figure 7:
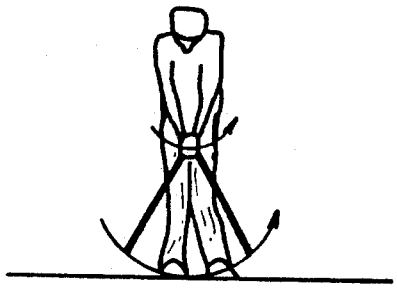

From this it is apparent that an appropriate grip-weighting has the effect of stabilizing the stroke and facilitating the swing of the club. The most appropriate grip-weighting cannot be determined to be one particular physical quantity. As a matter of fact, the most appropriate grip-weighting depends on individuals, specifically their statues, weights and other physical factors, such as their putting postures. FIGS. 7*a*, 7*b* and 7*c* show three different putting postures, which are hereinafter called "shoulder type", "arm type" and "tap type" respectively. The shoulder type of putting is very close to the pendulum swinging described above, permitting the head of the club to swing large amplitude, compared with the grip of the club. The majority of players of this type said, "The head runs, and the ball rolls well." In the arm type of putting the hands and the head move as a whole, and therefore, there is only a small difference between the head move and the grip move. The majority of players of this type did not feel that: the head runs, and the ball rolls well. Finally, the tap type of putting permits only little move of the grip, and therefore, the grip-weighting will cause little or no advantageous effect. In general, there are few golf players of perfect shoulder type or perfect arm type. Most golf players take the posture intermediate between these putting types. Few people take the posture of tap type.

Figure 8A:
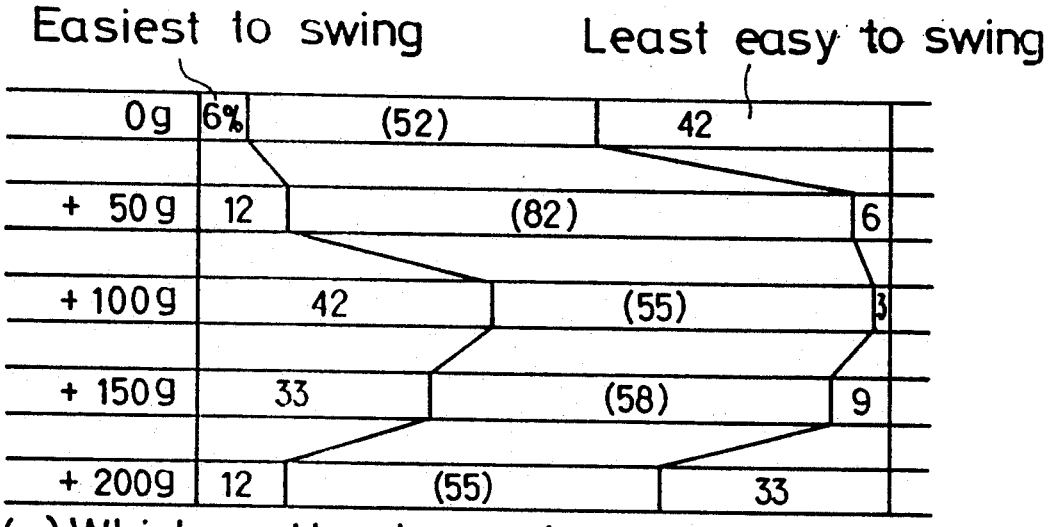
FIG. 8 shows the putting evaluations of some grip-weighted putters.
Figure 8B:
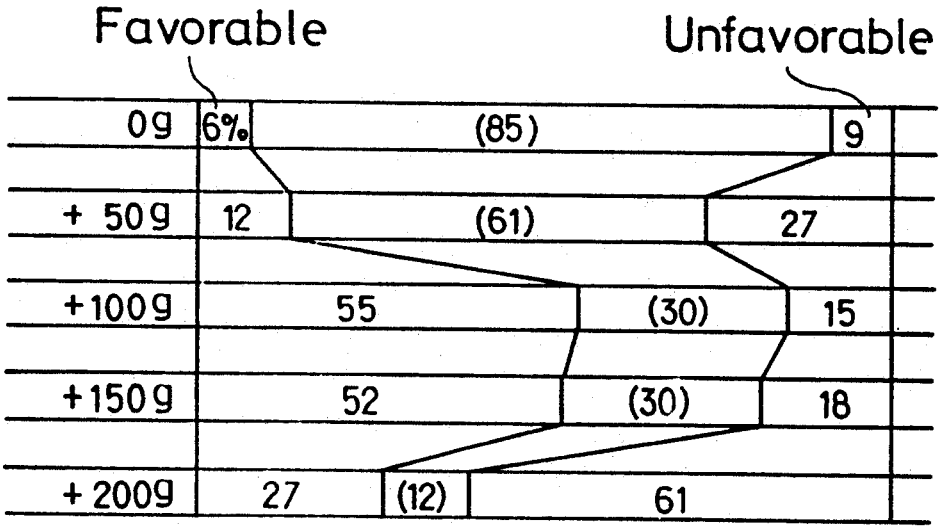

FIGS. 8*a* and 8*b* show the test results. A variety of evaluations appear to be attributable to individual difference, but putters whose grips have extra weight of 100 g or 150 g won popularity.

The above description pertains standard steel-shaft putters (shaft weighing 115 g) which were modified by weighting their grips and heads as described above. It, however, should by noted that Equations (1) to (6) can hold for putters using carbon black or any other light-weight shaft and that the same advantage as the above described examples can be provided by weighting their grips according to the present invention.

As may be understood from the above, the weighting of the grip and head of a putter according to the present invention has the effects of:

(1) increasing the head speed in the stroke and accordingly increasing the kinetic energy of the golf ball; improving the rolling of the ball; and extending the rolling-and running distance;

(2) shortening the distance from the grip end to the center of gravity of the club to facilitate the swing, and improve the stableness and directionality of the swing; and (3) positioning the center of gravity of the grip at the intermediate point of the grip length, thereby permitting both hands and the grip to be combined into an integral form, and accordingly facilitating the swing.

We claim:

1. A putter comprising a shaft having a head and a grip fixed to opposite ends of said shaft, said head fixed to one of said ends of said shaft and weighing from 320 to 360 grams, said grip fixed to the other one of said ends of said shaft and weighing from 100 to 260 grams, and the total weight of said head and grip ranging from 445 to 585 grams, said grip having a center of gravity from 100 to 150 millimeters from the grip end of said shaft.

* * * * *